US005353956A

United States Patent [19]

Wilson

[11] Patent Number: 5,353,956

[45] Date of Patent: Oct. 11, 1994

[54] CHEWING GUM DISPENSER

[76] Inventor: Edwin P. Wilson, 99 Cedar Grove Rd., Southbury, Conn. 06488-1930

[21] Appl. No.: 25,164

[22] Filed: Mar. 1, 1993

[51] Int. Cl.[5] ..... B65H 1/00

[52] U.S. Cl. ..... 221/198; 221/279; 206/800

[58] Field of Search ..... 221/279, 198, 197, 226, 221/270; 206/800, 39.4, 39.5, 555, 556

[56] References Cited

U.S. PATENT DOCUMENTS

| | | | |
|---|---|---|---|
| 1,025,805 | 5/1912 | Holden | 221/232 |
| 1,666,095 | 4/1928 | Jackson | 221/232 |
| 1,697,366 | 1/1929 | Offergelt | 221/232 |
| 1,714,737 | 5/1929 | Skoglund | 221/197 |
| 2,439,243 | 4/1948 | Dalkowitz | 206/16 |
| 2,544,501 | 3/1951 | Johnson | 221/279 |
| 3,710,977 | 1/1973 | Enden et al. | 206/555 |
| 4,465,208 | 8/1984 | Buban et al. | 221/279 |
| 4,852,727 | 8/1989 | Oberle | 206/556 |

FOREIGN PATENT DOCUMENTS

| | | | |
|---|---|---|---|
| 296399 | 12/1988 | European Pat. Off. | 221/279 |

*Primary Examiner*—Robert P. Olszewski
*Assistant Examiner*—Kenneth Noland

[57] ABSTRACT

A dispenser of chewing gum in stick form designed to hold a standard pack of gum sticks, including the outside wrapper either with the end removed or separate sticks in their individual wrappers, perhaps taken from a larger package. It has an internal sliding ejector, with an attached, thumb-operated actuator protruding through a slot in the side of the dispenser body. In operation of this dispenser, it is held in one hand while the thumb flips open the hinged cap and subsequently moves the actuator and ejector forward, exposing the end of the gum and making it available to grasp with the other hand or by another person. The remaining gum is then retracted by moving the actuator back with the thumb, after which the same thumb may flip the cover closed.

5 Claims, 1 Drawing Sheet

CHEWING GUM DISPENSER

BACKGROUND OF THE INVENTION

1. Field of the Invention

This invention relates to the dispensing of fiat, stackable, uniformly shaped products. More specifically, this invention focuses on the dispensing of chewing gum (gum) in stick form.

2. Prior Art

The majority of gum is sold in stick form in packs of five sticks which are individually wrapped, first with a piece of foil-backed (usually) paper, then with a paper band possibly depicting brand name, gum type and flavor and other information. The individual sticks are then wrapped five (or more) together in a sheath-like wrapper, sealed all around. The consumer tears off the end of the outside wrapper, exposing the ends of all five sticks in their individual wrappers; after removing a stick from the pack, the pack with one end open, is then usually placed in a pocket, a woman's purse or left lying somewhere. Experience has been that when the pack is placed in a pocket, body warmth causes the seal on the bottom and side of the wrapper to separate, causing the remaining loose sticks to disperse. Similarly, an opened gum pack in a womans purse invariably results in loose sticks of gum being scattered throughout. Not only is this an extreme nuisance but trying to locate a loose stick of gum with one hand while operating machinery, for instance, could be hazardous. Once the outside wrapper is opened, the gum has a tendency to dry out if not consumed in a timely manner. Half-stick portions, preferred by some people, have an exposed end and, if allowed to be loose in a pocket or purse, would attract particles of dirt, an unsanitary condition. Although prior invention, "Chewing Gum Dispenser" of R. M. and D. L. Buban U.S. Pat. No. 4,465,208 seems to solve the problem of loose sticks, it creates other problems that negate its utility. They assume that the coefficient of friction between the thumb and the top stick of gum is sufficient to overcome the friction on the other sides of the stick to eject the stick; this is dependent on thumb moisture and would not always work. The spring mechanism and overall design requires that the dispenser be considerably larger than the gum pack itself; its use would, therefore, not be embraced by a man who would carry it in a shirt or pants pocket. A stick of gum torn in half would have the saved half exposed to the unsanitary elements in a pocket or purse. Gum cannot be loaded as an entire pack, including its outside wrapper, but must be loaded as individual sticks. The primary (and apparently only) focus of their invention is to provide a device which "can be operated with one hand...without a need to look at the dispenser". I am personally not aware of this prior invention being available as a product since the granting of a patent in 1984. My invention is a dispenser, only slightly larger than a gum pack, operable with one hand, and closed off from the air all around to retain freshness and a sanitary condition, It does not rely on springs and therefore keeps the dimensions small; neither does it rely on thumb friction but instead an actuator (button) which provides positive action.

SUMMARY OF THE INVENTION

The object of this invention is to provide a dispenser, primarily for chewing gum, that will give the gum consumer a protective container that will prevent gum sticks from dispersing and/or melting in a pocket or purse.

Another object is to simplify the design so as to keep the size of the device as small as possible in order that it may be carried in a shirt or pants pocket.

Another object is for the dispenser to be operated by a positive actuator such as a thumb button rather than friction. This mechanism, as part of the ejector, also allows the dispenser to close off the gum from direct outside air and it will retain freshness if consumed over a period of time. This same concept keeps the gum sticks from being exposed to unsanitary conditions in the pocket or purse.

A further object is to give the gum consumer the opportunity to buy large, economy-size (more than five sticks) packs of gum which, ordinarily, are awkward to carry on one's person. Five sticks at a time can be loaded into the dispenser from the larger pack.

For those consumers who prefer to chew only one half stick at a time, the dispenser provides storage for the remaining half stick and the slide actuator moves far enough out of the dispenser body to expose the half stick when desired.

All the above objects are achieved by my invention which is a rectangular shaped container (dispenser) with a hinged cap and a sliding insert activated by a actuator (button) attached to the ejector, and protruding through the body of the dispenser and operated by the thumb. The dispenser is made of thin material which allows its size to be kept to a minimum. A pack of five sticks of gum (or five individual sticks) is inserted in the dispenser and are dispensed as desired. When closed, none of the gum sticks are exposed, giving some insulation from body heat, protection from dirt and helping to retain freshness.

DESCRIPTION OF THE PREFERRED EMBODIMENTS

Figure 1:
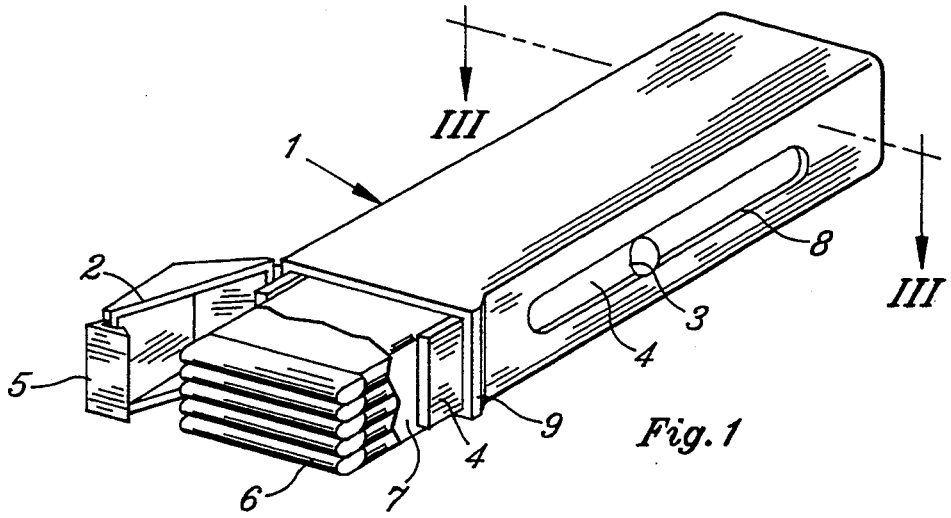
FIG. 1 is an isometric view of the dispenser with the cap open and the actuator in the halfway position. Further ejection would only be necessary in the case of a half piece of gum being saved although it could also be retrieved by turning the dispenser upside down.
Figure 2:
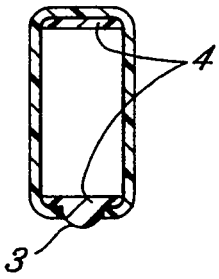
FIG. 2 is a cross-section taken on line II—II of FIG. 3.
Figure 3:
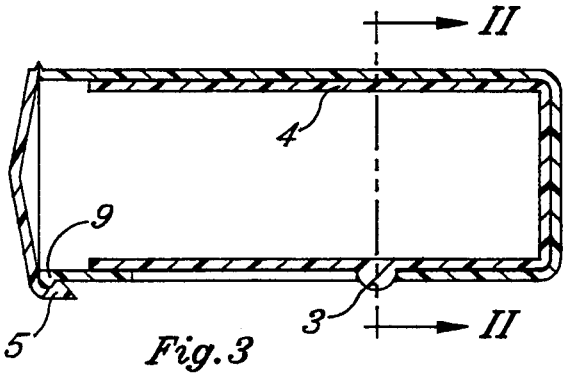
FIG. 3 is a cross-section of FIG. 1 taken on line III—III of FIG. 1.
Figure 4:
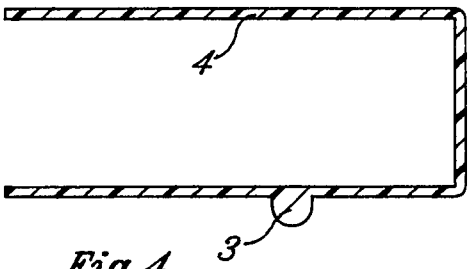
FIG. 4 is a side view of the ejector and actuator if removed from the dispenser body. When inserted in the dispenser body, its resilience causes it to remain flush to the interior of the body with the actuator protruding throught he slot in the dispenser body.
Figure 5:
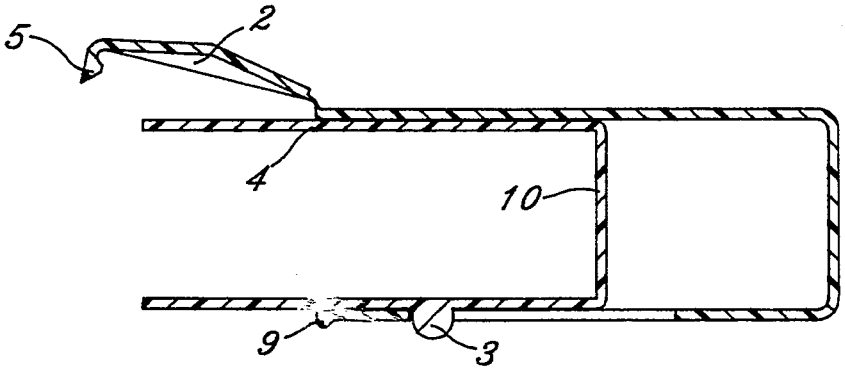
FIG. 5 is the same cross-section as FIG. 3 with the ejector fully extended. This allows a new pack or separate sticks to be inserted easily with no internal obstructions. When retracted, the length of the ejector provides a seal over the actuator slot.

When the dispenser 1 is held in either hand, it is operated by the thumb flipping open the cap 2. The cap (or lid) has a latch with a lateral slot 5 that fits over a ridge 9; when the two are pressed together, the cap is held closed. Then the thumb slides the actuator 3 forward in the slot 8 in the dispenser body 1 causing the ejector 4 to push the gum forward, exposing all the pieces in their two wrappers 6 and the outer wrapper 7 (with one end torn off). The large area of exposure given to the gum by the ejector facilitates grasping of an individual stick or half-stick by the other hand and, therefore, it is preferable to remove the outer wrapper from the gum sticks prior to their insertion in the dispenser. Ejection need only be as far as desired to retrieve a full or half stick of gum. Once the stick(s) of gum are removed, the reverse procedure is followed, i.e., the thumb slides the actuator back and the gum follows; the cap is pressed closed by the same thumb.

To refill the dispenser, the ejector 4 need not be removed, only slid forward by the actuator 3 to expose the forward part of the ejector 4, The new pack or separate gum sticks can then be inserted to the bottom of the ejector 10 and fully retracted, allowing the cap to be closed by the thumb.

I claim:

1. A dispenser for dispensing product comprising;

a one piece molded rectangular container of sufficient size to accommodate, product having four adjacent side walls, one side wall having a slot through which an actuator protrudes, a bottom wall connected on one end of each of the four adjacent side walls, a hinged cap wall attached to a side wall opposite the bottom wall said walls forming a sealed container;

a latch effective to latch the cap wall to at least one side wall, a sliding ejector being of a shape and size to fit in said rectangular container, having two sides and a bottom each proximate the respective container walls with its open end facing the open end of the said container and slidebly inserted in the container with the actuator protruding through the said slot in the container, said ejector three outside surfaces flush with the inside surfaces of two opposite side and the bottom of said container and slidable back and forth in a direction toward and away from the open end of said container under manual actuator operation and having sufficient length to provide a seal of said slot in the container side wall;

the said actuator being connection to the ejector and protruding through the said slot to the outside of the container, said dispenser adapted for one thumb disengagement of the latch, opening the hinged cap wall and sliding the actuator toward the open end to expose product and thereafter returning the actuator to rest position and latching the hinged end.

2. The dispenser of claim 1 wherein the cap wall has a snap lock in cooperation with the free end of the opposing side wall.

3. The dispenser of claim 2 wherein the ejector wall adjacent to the slot wall seals the slot at all times during use of the ejector.

4. The dispenser of claim 3 in which the product is chewing gum.

5. The dispenser of claim 1 wherein two side walls are narrower than the adjacent side walls and the slot is located in one of the narrower walls.

* * * * *